US008358217B2

(12) United States Patent
Wada et al.

(10) Patent No.: US 8,358,217 B2
(45) Date of Patent: Jan. 22, 2013

(54) STATIONARY INDUCTION APPARATUS AND MONITORING DEVICE THEREOF

(75) Inventors: Haruhisa Wada, Kanagawa (JP); Masaki Sugihara, Kanagawa (JP); Masahiro Hanai, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 974 days.

(21) Appl. No.: 12/033,457

(22) Filed: Feb. 19, 2008

(65) Prior Publication Data

US 2008/0197977 A1 Aug. 21, 2008

(30) Foreign Application Priority Data

Feb. 20, 2007 (JP) ..... 2007-039079

(51) Int. Cl.
*G08B 21/00* (2006.01)

(52) U.S. Cl. ..... 340/635; 340/10.51

(58) Field of Classification Search ..... 340/500, 340/531, 539.1, 10.1–10.6, 572.1–572.9, 340/635; 235/375–385
See application file for complete search history.

(56) References Cited

U.S. PATENT DOCUMENTS

| | | | | |
|---|---|---|---|---|
| 5,530,366 | A * | 6/1996 | Nasrallah | 324/547 |
| 6,014,083 | A * | 1/2000 | Bauerschmidt et al. | 340/635 |
| 6,100,693 | A * | 8/2000 | Eberler et al. | 324/318 |
| 7,339,447 | B2 * | 3/2008 | Chen et al. | 333/242 |
| 7,377,689 | B2 * | 5/2008 | Balan | 374/152 |
| 2004/0052064 | A1 * | 3/2004 | Oliver et al. | 361/816 |
| 2005/0214974 | A1 * | 9/2005 | Field et al. | 438/106 |
| 2006/0273905 | A1 * | 12/2006 | Choi et al. | 340/572.1 |
| 2008/0079550 | A1 * | 4/2008 | Briggs et al. | 340/10.34 |

FOREIGN PATENT DOCUMENTS

| | | | |
|---|---|---|---|
| JP | 04-015551 | A | 1/1992 |
| JP | 07-320955 | A | 12/1995 |
| JP | 2002-130675 | A | 5/2002 |
| JP | 2004-24551 | A | 1/2004 |
| JP | 2004-133596 | A | 4/2004 |
| JP | 2005-345216 | A | 12/2005 |
| JP | 2006-185048 | A | 7/2006 |
| JP | 2006-194929 | A | 7/2006 |
| JP | 2006-307209 | A | 11/2006 |

* cited by examiner

*Primary Examiner* — Brian Zimmerman
*Assistant Examiner* — James Yang
(74) *Attorney, Agent, or Firm* — Foley & Lardner LLP

(57) ABSTRACT

A stationary induction apparatus has: a winding to which AC current is supplied; an electrostatic shield which includes an electrostatic shield member having a hollow and an electrically conductive film wound around the electrostatic shield member, and which is configured to suppress the electric field of the winding; a housing which contains the winding, the electrostatic shield and the insulating fluid; an IC tag which has a sensor arranged in the hollow of the electrostatic shield member and configured to detect position of the electrostatic shield member, and a transmitter unit configured to transmit, by radio, information acquired by the sensor as a high-frequency signal having a frequency much higher than the frequency of the AC current; and a receiver unit which is arranged in the housing, receives the high-frequency signal transmitted by radio from the IC tag and transmits, by wire, the signal outside the housing.

10 Claims, 3 Drawing Sheets

STATIONARY INDUCTION APPARATUS AND MONITORING DEVICE THEREOF

CROSS REFERENCES TO RELATED APPLICATIONS

The present invention contains subject matter related to Japanese Patent Application No. 2007-039079, filed in the Japanese Patent Office on Feb. 20, 2007, the entire content of which is incorporated herein by reference.

BACKGROUND OF THE INVENTION

The present invention relates to a stationary induction apparatus, such as a high-voltage transformer, which should be contained in a housing.

A stationary induction apparatus has windings which are made of electric wires covered with an insulating coating and which are immersed in insulating fluid (insulating medium) such as oil. The windings are heated with an electric current and cooled with the insulating fluid. The insulating fluid flows by convection in the apparatus, is cooled in a heat-exchanging cooler provided in the housing of the stationary induction apparatus or outside the stationary induction apparatus, and flows back to the windings. The insulating material is an organic material in most cases and gradually decomposes. The rate at which the insulating material decomposes is greatly influenced by the amount of oxygen mixed into the insulating material and the temperature of the insulating material. If the apparatus malfunctions, a part of the insulating material may undergo dielectric breakdown. In this case, the part of the insulating material is damaged or decomposes. When the material is damaged or decomposes, a high-frequency signal is generated in the electric line, and an electromagnetic wave emanates from the discharging part. The electromagnetic wave decreases in magnitude in inverse proportion to the square of the distance from the position where it has generated. Hence, a small breakdown can be detected if the electromagnetic wave is caught near the position where it has generated.

On the conventional stationary induction apparatus, a monitoring device is mounted outside the stationary induction apparatus to monitor the operating state of the stationary induction apparatus. The monitoring device monitors the apparatus, either periodically or continuously. The monitoring device analyzes the temperature and composition of the insulating fluid, thus evaluating the functional efficiencies of the fluid, such as insulating efficiency. The insulating material is liable to degradation or damages because a high voltage is applied and current flows through the windings. As the material is degraded or damaged, it decomposes, generating some substances. These substances flows into the insulating fluid and are carried, by convection of the fluid, to a sensor unit that is provided in the housing.

The heat generated from the current is also transferred by the convection in the insulating fluid. The insulating fluid does not flow at a uniform speed in the housing. That is, the insulating fluid flows at different speeds at different positions in the housing. The insulating fluid starts undergoing convection when the fluid receives the heat generated at the lower parts of the windings. Since heat is generated at the entire windings, not at parts thereof, the insulating fluid receives heat not only by heat convention but also directly from the windings. The fluid reaches the highest temperature where the fluid flows to the upper parts of the windings. The heat is transmitted not only by convection in the fluid, but also by radiation from the fluid. Therefore, in most cases, the top center part of the apparatus is most heated than any other part of the apparatus. Any organic insulating material that is used in ordinary stationary induction apparatuses decomposes with time. The rate with which the material decomposes depends on its temperature.

The insulating material is likely to decompose and an abnormal signal is likely to develop at high-voltage regions of the windings. The monitoring device needs to be located at a ground-potential position. The device should be electrically insulated from a sensor. Most sensors include a detecting unit, a converting/amplifying unit, and a signal-transmitting unit. These sensor parts require energy to operate. They acquire energy from the monitoring device, from the environment in which they are used, or from the signals that they have detected. In the environment, the sensor parts obtain energy from vibration, temperature difference, light or electromagnetic wave emanating from an electric or magnetic field. If the sensor parts acquire energy from a control panel, they receive the energy directly from a power supply or the energy converted in the sensor unit from light. Signals may be transmitted as electric signals, optical signals or mechanical-displacement signals. Optical signals are transmitted as modulated luminance signals or modulated color signals.

Generally, sensors using electric signals cannot be disposed at or near any high-voltage regions. A sensor that is disposed at a high-voltage region, for example, has an insulating member such as optical fiber. However, a sensor of this type is not fit for monitoring general-purpose apparatuses, because the sensor of this type needs to transmit optical signals, the optical fiber also must be insulated, and signals are acquired in only a few types. Further, the sensor of this type cannot directly receive electric energy. The sensor of this type receives optical energy or uses, as energy source, the electric field available at the position where the sensor is provided.

Typical stationary induction apparatuses have magnetic shields at various positions, for inducing leakage magnetic fluxes. The windings have electrostatic shields for moderating electric fields. Therefore, communication using an electromagnetic technique cannot be achieved in the regions that these shields protect.

As can be seen from the above, it is extremely difficult to provide sensors capable of detecting various signals and condition to monitor the operating state of the stationary induction apparatus, at high-voltage regions. Typical stationary induction apparatuses are used for a long time and are so huge that no access is easy to their interior. Therefore, signals can hardly be electrically transmitted from sensors so that the sensors may be disposed at high-voltage regions. To transmit the signals, the signals must be converted to such signals as can be easily transmitted while maintaining their insulation state. This signal conversion requires energy. The sensor unit therefore needs to incorporate a battery. Alternatively, power needs to be generated at the sensor unit.

In order to transmit signals optically, the optical fiber used needs to be insulated well. To transmit signals mechanically, the mechanical component working as transmission medium needs to be made of insulating material. Such a mechanical component can hardly be provided easily at low cost. Electromagnetic signals may be transmitted. However, they are likely to contain noise because the high-voltage components are connected to external electric lines. Moreover, signals cannot be so easily transmitted from the sensors, because the apparatus generates low-frequency signals and an intense low-frequency magnetic field, has a structure for shielding the signals and the magnetic field, and includes electrical conductors that hardly allow electromagnetic waves to leak, making it difficult to transmit signals outside.

If a sensor is disposed at a high-voltage region, drive energy needs to be supplied to the sensor unit. Electrical connection for supplying the energy to the sensor unit cannot be accomplished, because the sensor unit is set at high voltage. The energy can be supplied in the form of light if a solar cell is disposed at the sensor unit and the sunlight is applied to the solar cell via an optical fiber. The solar cell can hardly be used in practice, because the solar cell has but low energy-conversion efficiency and generates heat. Power may be generated from the electric or magnetic field of the commercial frequency the apparatus transforms. This method of generating power can hardly be put to practical use, because the operating current changes at all the times and the unit for generating power is required to be manufactured at high precision.

In consideration of the foregoing, IC (integrated circuit) tags and IC tag systems have been invented, as publicly known. The IC tag has a sensor, is set in an apparatus to acquire information about the interior of the apparatus, uses electromagnetic waves generated in the apparatus as its operating energy, and records the magnitude of each electromagnetic wave and the number of electromagnetic waves. The drive energy for the IC tag having a sensor is the power supplied from a battery or a communication electromagnetic wave.

The IC tags having a sensor, disclosed in Japanese Patent Application Laid-Open Publication Nos. 2004-133596 and 2002-130675, the entire contents of which are incorporated herein by reference, are based on the assumption that the tag only transmits detected information and that the user at a remote site determines whether a trouble has developed in an apparatus. Hence, the IC tag has no functions of automatically recording or accumulating the information. If the IC tag has a memory function, the tag keeps holding the operating history of the apparatus even if after the tag has been removed from the apparatus.

Japanese Patent Application Laid-Open Publication No. 2006-185048, the entire content of which is incorporated herein by reference, discloses a technique of using the electromagnetic waves generated in the apparatus as operating energy. Further, the electromagnetic waves generated as information representing a trouble in the sensor that records the magnitude of each electromagnetic wave and the number of electromagnetic waves is used as operating energy, too. Therefore, no operation is performed if no troubles develop.

The above-identified Japanese Patent Application Laid-Open Publications propose that a sensor should be disposed at a region where any sensor has hitherto been hardly provided. However, any electromagnetic environment that may influence the communication or the sensor is not taken into consideration. Particularly, no technique is disclosed, which may prevent an intense electric field, other than one used for communication and transmitting drive energy, from disabling the communication with the apparatus or from damaging the electronic circuit provided in the apparatus.

If an IC tag is incorporated in a stationary induction apparatus, the IC tag should be set at a position electromagnetically shielded or a position where no electromagnetic waves reach, or should be protected from electromagnetic waves by taking some measures. Unless the IC tag is so positioned or so protected, the IC tag may be broken by the intense electric field or intense magnetic field that the main apparatus generates.

BRIEF SUMMARY OF THE INVENTION

In consideration of the foregoing, the present invention has been made. An object of the invention is to provide a stationary induction apparatus which includes high-voltage windings and whose interior state is detected by a sensor that generates a signal, which is output from the housing of the apparatus.

In order to attain the object, according to an aspect of the present invention, there is provided a stationary induction apparatus comprising: a winding to which a commercially available AC current with a frequency is supplied; insulating fluid which insulates the winding; an electrostatic shield which includes an electrostatic shield member having a hollow in at least one part and an electrically conductive film wound around the electrostatic shield member and having electrical resistance, and which is configured to suppress the electric field of the winding; a housing which contains the winding, the electrostatic shield and the insulating fluid and which seals the insulating fluid; an IC tag which has a sensor arranged in the hollow of the electrostatic shield member and configured to detect position of the electrostatic shield member, as a physical quantity, and a transmitter unit configured to transmit, by radio, information acquired by the sensor as a high-frequency signal having a frequency much higher than the frequency of the commercially available AC current; and a receiver unit which is arranged in the housing, receives the high-frequency signal transmitted by radio from the IC tag and transmits, by wire, the signal outside the housing.

According to another aspect of the present invention, there is provided a stationary induction apparatus comprising: a winding to which a commercially available AC current with a frequency is supplied; a core through which a magnetic flux is made to flow; insulating fluid which insulates the winding; a magnetic shield which is made of a material containing steel that exhibits high permeability to the frequency of the commercially available AC current and low permeability to any frequency higher than the frequency of the commercially available AC current; a high-frequency magnetic path which exhibits low permeability to the frequency of the commercially available AC current and high permeability to high-frequency waves; an IC tag which has a sensor arranged in a vicinity of the high-frequency magnetic path and configured to detect position of the high-frequency magnetic path, as a physical quantity, and a transmitter unit configured to transmit, by radio, information acquired by the sensor as a high-frequency signal having a frequency much higher than the frequency of the commercially available AC current; a housing which contains the winding, the core, the magnetic shield, the high-frequency magnetic path, the IC tag and the insulating fluid and which seals the insulating fluid; and a receiver unit which is arranged in the housing, receives the high-frequency signal transmitted by radio from the IC tag through the winding and transmits, by wire, the signal outside the housing.

According to yet another aspect of the present invention, there is provided a stationary induction apparatus comprising: a winding to which a commercially available AC current with a frequency is supplied; insulating fluid which insulates the winding; an IC tag which has a sensor configured to detect position of the IC tag, as a physical quantity, and a transmitter unit configured to transmit, by radio, information acquired by the sensor as a high-frequency signal having a frequency much higher than the frequency of the commercially available AC current, and which is arranged in a vicinity of the winding and has a coupling part having a coupling direction different from a main direction of an electric or magnetic field generated by the winding; a housing which contains the winding, the IC tag and the insulating fluid and which seals the insulating fluid; and a receiver unit which is arranged in the housing, receives the high-frequency signal transmitted by radio from the IC tag through the winding and transmits, by wire, the signal outside the housing.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

First Embodiment

Figure 1:
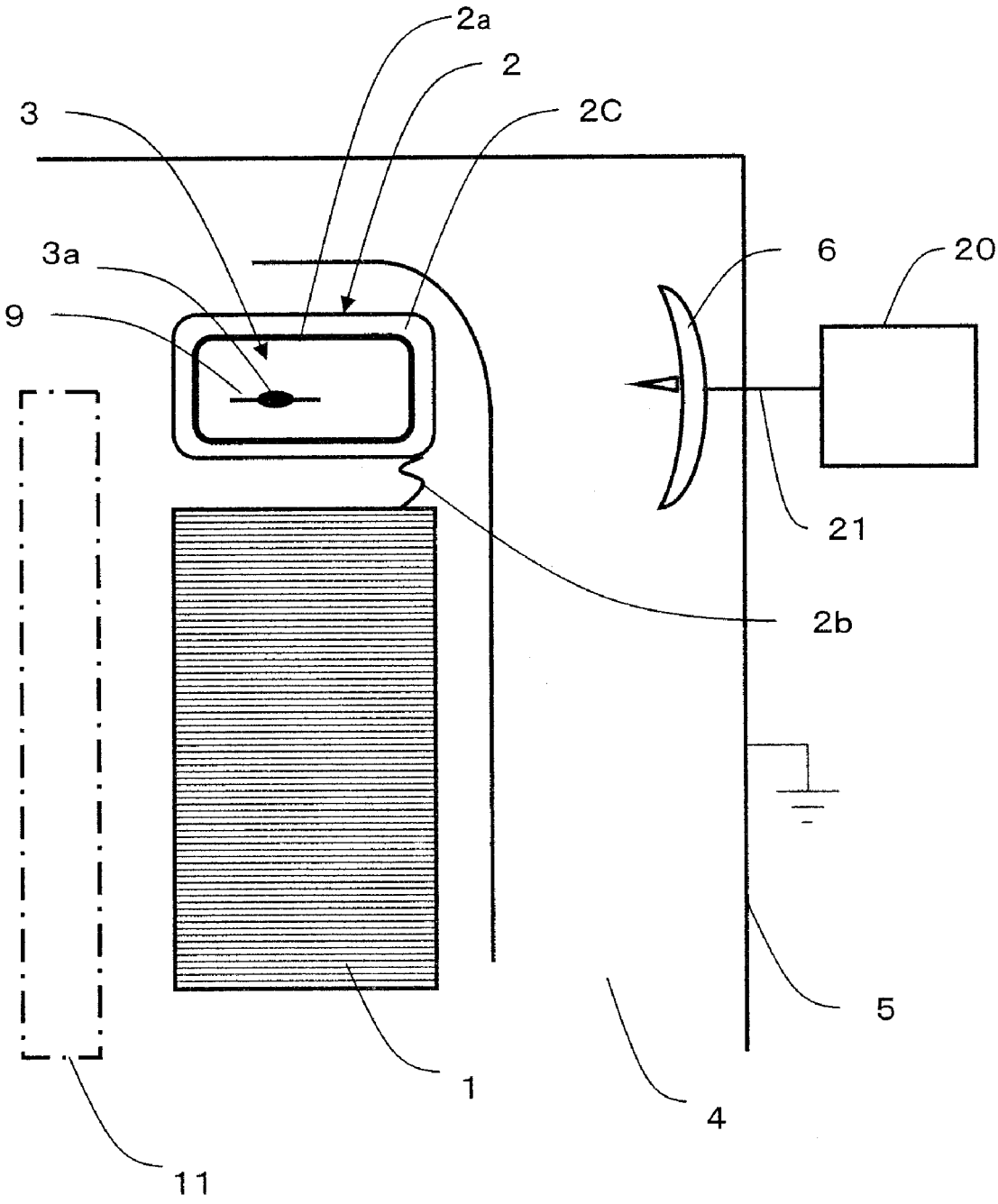
FIG. 1 is a schematic, sectional partial view showing a stationary induction apparatus according to a first embodiment of the present invention.

FIG. 1 is a schematic, sectional partial view showing a stationary induction apparatus according to a first embodiment of the present invention. The stationary induction apparatus is, for example, a transformer. A winding 1 and a core 11 are immersed in insulating fluid 4 filled in the housing 5. The insulating fluid 4 is a liquid organic medium such as oil. The winding 1 is supported by a winding insulator (not shown) that is made of, for example, organic material. The winding 1 receives a commercially available AC (alternating current) current at a high voltage (e.g., 60,000 to 1,000,000 V), through terminals (not shown) from outside the housing 5. The commercially available AC current has a frequency of 50 Hz or 60 Hz. The housing 5 is connected to the ground.

In the housing 5, an electrostatic shield 2 is arranged above the winding 1. The electrostatic shield 2 includes a hollow shield core 2*a* and a semiconductor insulating paper sheet 2*c* wrapped around the hollow shield core 2*a*. The electrostatic shield 2 is shaped like a ring and located above the winding 1. The semiconductor insulating paper sheet 2*c* is connected at its winding end 2*b* to the winding 1 and is set at a potential.

An IC tag 3 having a sensor is arranged in the shield core 2*a* of the electrostatic shield 2. The IC tag 3 having a sensor includes a main unit 3*a* and an antenna 9. The main unit 3*a* includes a sensor and a transmitter unit (not shown). In the housing 57 a receiver unit 6 is arranged near a wall of the housing 5. Further, a decision/display unit 20 is provided outside the housing 5. The receiver unit 6 and the decision/display unit 20 are connected by a communication line 21 that penetrates the wall of the housing 5.

With respect to the frequency of the commercially available current, the electrostatic shield 2 is maintained, as a whole, at the same potential. The information the sensor of the IC tag 3 has acquired is transmitted as a signal that has a frequency (e.g., tens of megahertz or higher) much higher than that of the commercially available AC current. Since the surface of the electrostatic shield 2 is semi-conducting, it is not at a uniform potential to ultra-high frequencies. The signal coming from the IC tag 3 having a sensor easily leaks outside the electrostatic shield 2. The signal thus leaking arrives at the receiver unit 6, whereby data communication is accomplished. The signal exchange between the receiver unit 6 and the decision/display unit 20 is achieved by a wire, namely by the communication line 21. The IC tag 3 having a sensor acquires operating energy from a battery or from ultra-high frequency waves transmitted to the IC tag 3.

In the present embodiment, the IC tag 3 having a sensor and provided within the electrostatic shield 2 can monitor the condition above the winding 1, at which the temperature is highest, instantaneously with high accuracy. It is not that an average temperature in the housing 5 is detected by sensors that may be provided on the walls of the housing 5. Rather, the highest temperature in the housing 5 is detected. Hence, the interior state of the apparatus can be detected accurately.

In this embodiment described above, the sensor can have an ability of receiving power by using electromagnetic waves. Moreover, the IC tag 3 having a sensor or the receiver unit 6 may have an energy-converting means that converts the vibration energy generated by applying the commercially available AC current into electric energy. The electric energy may be used as energy for driving the IC tag 3 having a sensor. Alternatively, the IC tag 3 having a sensor or the receiver unit 6 may have an energy-converting means that converts the electromagnetic-wave energy resulting from the partial discharge induced in the housing 5 by the application of the commercially available AC current or the magnetic field energy generated in the housing 5 from the commercially available AC current, into electric energy.

Moreover, signals may be transmitted by using electromagnetic waves, making it possible to dispose a sensor unit at a high-voltage region. Further, the sensor unit may have an ability of recording information. Then, if the signals can hardly be transmitted by using electromagnetic waves, the state of the apparatus is first recorded and the information representing the state is then transferred later. In this case, the sensor can be provided even at a position where electromagnetic waves can hardly reach. The electromagnetic environment is influenced by the operating state of the apparatus and the electric line connected to the apparatus. Unless the apparatus is stopped, the electromagnetic communication can be achieved only if the apparatus is disconnected from a system.

The electrostatic shield is made of electrically conducting material. It is sufficient for the electrostatic shield to have electrical conductivity and potential fixing property with respect to a main electric field. Therefore, generally, the shield is a thin metal foil or semi-conducting paper such as carbon paper. The shield is connected, at only one part, to the potential line. Similarly, a magnetic shield made of material having high permeability induces magnetic fluxes, and therefore controls magnetic fields. Hence, it has hitherto been impossible to provide a sensor device with an electromagnetic transmitting means, in or near the magnetic shield. If ultra-high frequency waves are used to supply energy and transmit signals, the shield cannot perform its function as desired. This is because the impedance is high, from the potential-connecting point to a remote position, but the potential is controlled to the connected potential at the potential-connecting point and therefore achieves a shield effect.

In the present embodiment, ultra-high frequency waves are used to transmit signals, and the sensor device can be provided in an electrostatic shield. Since the intense electric field emanating from the main apparatus has the commercial frequency, the use of semi-conducting paper or thin metal foil raises no problems. Similarly, since silicon steel sheets or the like has poor frequency characteristic and cannot fully induce magnetic fluxes having ultra-high frequency; signals of ultra-high frequency can easily reach the back of a magnetic shield. In this embodiment, signals are transmitted by using ultra-high frequency electromagnetic waves, the electrostatic shield is either semi-conducting paper or thin metal foil, and the magnetic shield is a steel sheet that is inferior in frequency characteristic. Hence, the embodiment can provide a sensor device which has a shield sufficiently effective to the intense electric field or magnetic field generated by the apparatus and having a commercial frequency, and which has, in or near the shield, a signal transmitting means for transmitting ultra-high frequency signals.

In the first embodiment, a sensor is connected to the IC tag having a sensor, and the information acquired is transmitted by using ultra-high frequency electromagnetic waves. Thus, the information acquired by the sensor disposed at the high-voltage region can be transmitted to a ground-potential region, without degrading the insulating ability. Since the sensor is disposed at the high-voltage region where the lifetime or performance of the apparatus is affected most, it can accurately monitor the remaining lifetime and degradation degree of the apparatus, which have hitherto been detected as the average values at all regions of the apparatus.

The materials or compositions of the various shields may be adjusted, thereby to achieve communication by using ultra-high frequency waves. Thus, the influence of the extremely intense electromagnetic field generated by the apparatus and having the commercial frequency is evaded, while the IC tag having a sensor is arranged in or near the shield. As a result, the sensor can be arranged near the shield, and can detect the state at a high-voltage region or the state of the intense magnetic field. In addition, the information acquired by the sensor can be transmitted by using high-frequency waves.

An ultra-high frequency signal may be superposed on an electrical path connected to the apparatus. In this case, the receiver unit for receiving information from the IC tag having a sensor can be arranged outside the apparatus. Thus, the interior state of the apparatus can be monitored, without altering the design of the housing.

Particularly, an IC tag having a sensor and configured to store the temperature history may be provided near the position where the temperature is highest. This prevents detection errors that may otherwise be made upon detecting the average degradation of the insulating material used. An error may occur if the degradation is determined by dividing the mass of the damaged product by the volume of the entire insulating material. In the present embodiment, the state of the damaged part is monitored by the IC tag having a sensor, which is arranged near the damaged part. Therefore, the state of the damaged part can be detected accurately to monitor the state of the apparatus with high precision.

Second Embodiment

Figure 2:
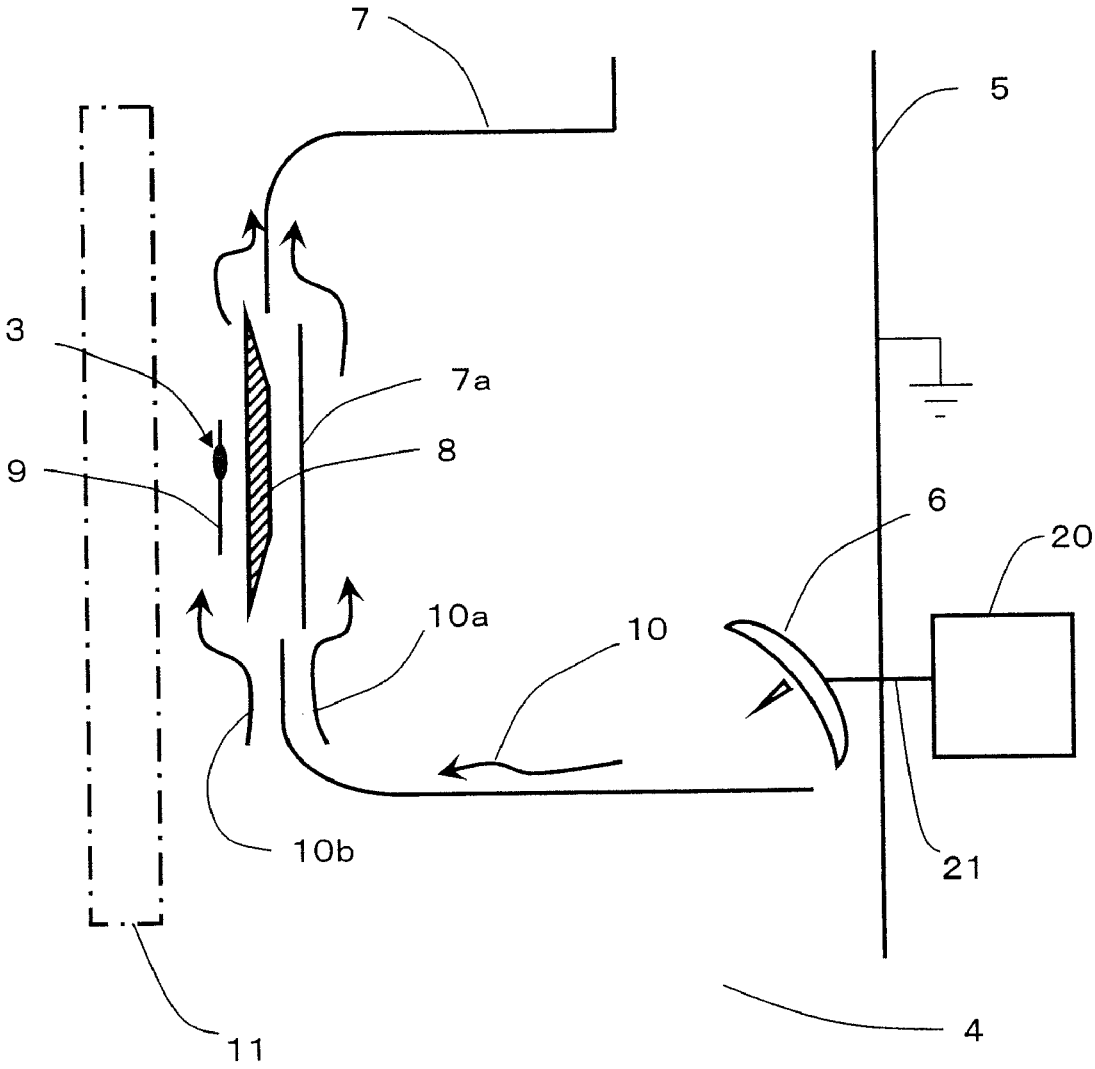
FIG. 2 is a schematic, sectional partial view showing a stationary induction apparatus according to a second embodiment of the invention.

A second embodiment of the present invention will be described, with reference to FIG. 2. The components identical or similar to those of the first embodiment are designated by the same reference numbers, and will not be described repeatedly. FIG. 2 is a schematic, sectional partial view showing a stationary induction apparatus according to the second embodiment. In this embodiment, the magnetic shield 7 has a low-frequency high-permeability magnetic shield 7*a*. The magnetic shield 7*a* is an electromagnetic steel sheet having poor frequency characteristic. A magnetic path 8 made of magnetic material (e.g., ferrite) having a good high-frequency characteristic but a lower permeability than the magnetic shield 7*a* is arranged near the low-frequency high-permeability magnetic shield 7*a*. An IC tag 3 having a sensor is provided above the magnetic path 8.

Of magnetic fluxes 10, the low-frequency magnetic flux 10*a* generated by the apparatus is induced to the low-frequency high-permeability magnetic shield 7*a*. The low-frequency magnetic flux 10*a* is scarcely leaked to the magnetic path 8. The permeability that the low-frequency high-permeability magnetic shield 7*a* has with respect to ultra-high frequency waves is close to 1. Hence, the ultra-high frequency magnetic flux 10*b* reaches the IC tag 3 having a sensor, passing through the magnetic path 8. Information detected is transmitted through the magnetic path 8 to a receiver unit 6 provided in the housing 5.

In this embodiment, the low-frequency magnetic flux 10*a* of the commercial frequency travels to the low-frequency high-permeability magnetic shield 7*a*. The magnetic coupled part of the IC tag 3 having a sensor can have its magnetic-coupling efficiency increase enough not to cause saturation by a very small leakage flux. In other words, the IC tag 3 can have an ultra-high frequency coupling part (antenna) 9 that has a gain large enough to catch even weak ultra-high frequency signals. Therefore, the energy required to transmit information is small. This lengthens the lifetime of the battery incorporated in the sensor. As a result, the IC tag 3 can be used for a long time.

Third Embodiment

Figure 3:
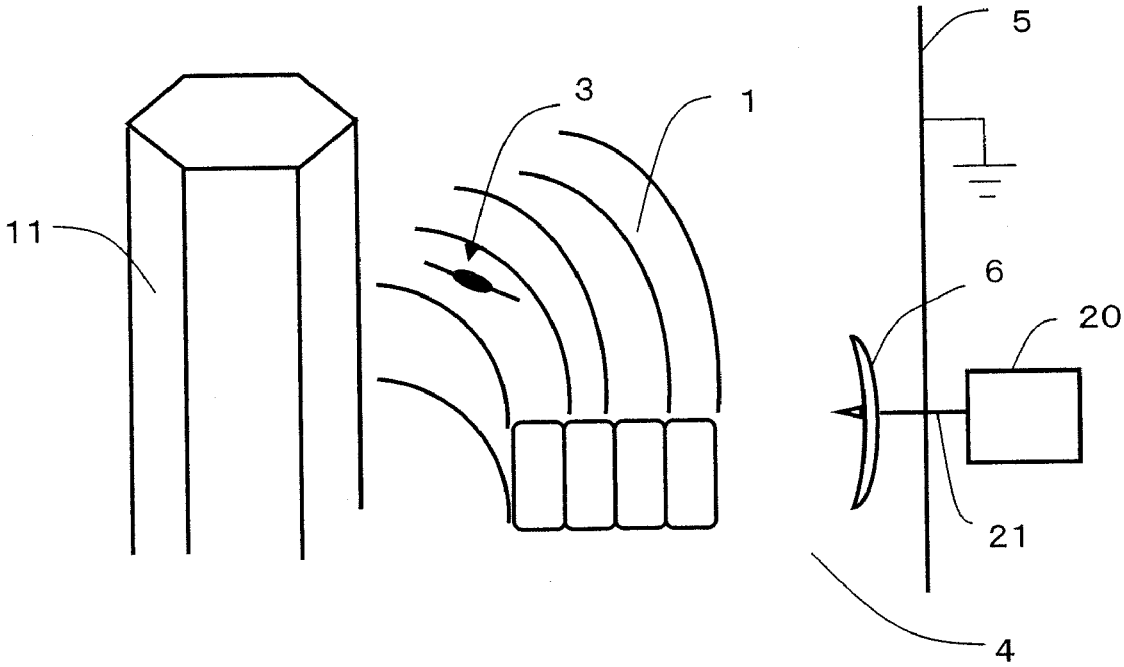
FIG. 3 is a schematic, partially perspective and partially sectional view showing a stationary induction apparatus according to the third embodiment of the invention.
Figure 4:
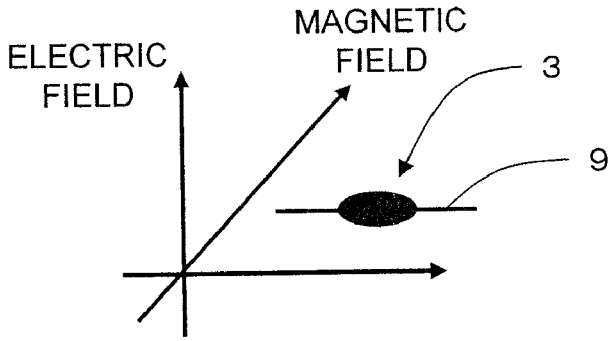
FIG. 4 is a schematic perspective view of the IC tag having a sensor, which is shown in FIG. 3.

A third embodiment of the invention will be described, with reference to FIGS. 3 and 4. The components identical or similar to those of the first and second embodiments are designated by the same reference numbers, and will not be described repeatedly. FIG. 3 is a schematic, partially perspective and partially sectional view showing a stationary induction apparatus according to the third embodiment. FIG. 4 is a schematic perspective view of the IC tag having a sensor, which is shown in FIG. 3.

In this embodiment, an IC tag 3 having a sensor is disposed at a high-voltage region. The IC tag 3 has an ultra-high frequency electromagnetic wave coupling part set in a direction different from the direction in which the electromagnetic waves of the commercial frequency travel from the apparatus. The stationary induction apparatus is connected to an electric line of high impedance or to a ground terminal. To the ground terminal or the electric line, a receiver unit 6 is high-frequency coupled to receive ultra-high frequency signals. An impedance element is provided on the electric line or the ground line, to prevent the leakage of ultra-high frequency signals.

As shown in FIG. 3, the IC tag 3 having a sensor is arranged near the winding 1, and the antenna 9 is directed toward the winding 1. As a result, the antenna 9 extends perpendicular to the direction of the electric field and to the direction of the magnetic field as shown in FIG. 4.

The stationary induction apparatus is large and electromagnetic waves of the commercial frequency have a certain directivity in a space. The electric field generated by the winding 1 and extending in the direction of the winding 1 is weak. The magnetic fluxes between the adjacent electric wires cancel out one another, and the magnetic field is therefore weak. Since the electromagnetic waves of ultra-high frequency propagate along the electric wire as in a distribution-constant line, a sufficiently large electromagnetic field develops in the above-mentioned space. The IC tag 3 having a sensor, which is disposed at a high-voltage region, is located in the space where a weak electromagnetic field of the commercial frequency is generated. The information detected is induced to the electric wire of the apparatus from the ultra-high frequency coupling part 9 of the IC tag 3 having a sensor, travels along the electric line of the apparatus and propagates outside the apparatus.

In the present embodiment, the IC tag 3 having a sensor has an ultra-high frequency coupling part that is directed to the direction in which the electromagnetic waves of the commercial frequency are weak. Hence, the high-frequency signals can be superposed on the electric line part of the apparatus, without being interfered with the intense electromagnetic field of the commercial frequency generated by the apparatus. Therefore, the IC tag 3 having a sensor and the receiver unit 6 configured to receive signals need not be opposed to a high-voltage component. Disposed at a safe position, the receiver unit 6 can acquire the information about the high-voltage region.

What is claimed is:

1. A stationary induction apparatus comprising:

a winding to which a commercially available AC current with a frequency is supplied;

an insulating fluid which insulates the winding;

an electrostatic shield which includes an electrostatic shield member having a hollow in at least one part and an electrically conductive film wound around the electrostatic shield member and having electrical resistance, and which is configured to suppress the electric field of the winding;

a housing which contains the winding, the electrostatic shield and the insulating fluid and which seals the insulating fluid;

an IC tag which has a sensor arranged in the hollow of the electrostatic shield member and configured to detect position of the electrostatic shield member, as a physical quantity, and a transmitter unit configured to transmit, by radio, information acquired by the sensor as a high-frequency signal having a frequency higher than the frequency of the commercially available AC current; and a receiver unit which is arranged in the housing, receives the high-frequency signal transmitted by radio from the IC tag through the electric shield and transmits, by wire, the signal outside the housing, wherein the electrostatic shield is maintained as a whole at a uniform potential with respect to the frequency of the commercially available AC current, while the electrostatic shield is not a uniform potential with respect to the frequency of the high-frequency signal transmitted from the transmitter unit.

2. The stationary induction apparatus according to claim 1, further comprising a winding-insulating member which supports the winding and which includes organic material.

3. The stationary induction apparatus according to claim 1, further comprising energy-converting means for converting vibration energy generated by supplying the commercially available AC current to the winding, into electric energy, the energy-converting means being disposed in the housing, wherein the IC tag is driven by the electric energy generated by the energy-converting means.

4. The stationary induction apparatus according to claim 1, further comprising energy-converting means for converting electromagnetic-wave energy discharged due to partial discharge developing in the housing by supplying the commercially available AC current to the winding, into electric energy, the energy-converting means being disposed in the housing, wherein the IC tag is driven by the electric energy generated by the energy-converting means.

5. The stationary induction apparatus according to claim 1, further comprising energy-converting means for converting magnetic-field energy generated in the housing by supplying the commercially available AC current to the winding, into electric energy, the energy-converting means being disposed in the housing, wherein the IC tag is driven by the electric energy generated by the energy-converting means.

6. A stationary induction apparatus comprising:

a winding to which a commercially available AC current with a frequency is supplied;

a core through which a magnetic flux is made to flow;

an insulating fluid which insulates the winding;

a magnetic shield which is made of a material containing steel that exhibits high permeability to the frequency of the commercially available AC current and low permeability to any frequency higher than the frequency of the commercially available AC current;

a high-frequency magnetic path which exhibits low permeability to the frequency of the commercially available AC current and high permeability to high-frequency waves;

an IC tag which has a sensor arranged in a vicinity of the high-frequency magnetic path and configured to detect position of the high-frequency magnetic path, as a physical quantity, and a transmitter unit configured to transmit, by radio, information acquired by the sensor as a high-frequency signal having a frequency higher than the frequency of the commercially available AC current;

a housing which contains the winding, the core, the magnetic shield, the high-frequency magnetic path, the IC tag and the insulating fluid and which seals the insulating fluid; and a receiver unit which is arranged in the housing, receives the high-frequency signal transmitted by radio from the IC tag through the winding and transmits, by wire, the signal outside the housing.

7. The stationary induction apparatus according to claim 6, further comprising a winding-insulating member which supports the winding and which includes organic material.

8. The stationary induction apparatus according to claim 1, further comprising energy-converting means for converting vibration energy generated by supplying the commercially available AC current to the winding, into electric energy, the energy-converting means being disposed in the housing, wherein the IC tag is driven by the electric energy generated by the energy-converting means.

9. The stationary induction apparatus according to claim 6, further comprising energy-converting means for converting electromagnetic-wave energy discharged due to partial discharge developing in the housing by supplying the commercially available AC current to the winding, into electric energy, the energy-converting means being disposed in the housing, wherein the IC tag is driven by the electric energy generated by the energy-converting means.

10. The stationary induction apparatus according to claim 6, further comprising energy-converting means for converting magnetic-field energy generated in the housing by supplying the commercially available AC current to the winding, into electric energy, the energy-converting means being disposed in the housing, wherein the IC tag is driven by the electric energy generated by the energy-converting means.

* * * * *